US005901797A

United States Patent [19]

Hansen et al.

[11] Patent Number: 5,901,797

[45] Date of Patent: May 11, 1999

[54] DRILLING APPARATUS WITH DYNAMIC CUTTINGS REMOVAL AND CLEANING

[75] Inventors: Wayne R. Hansen, Centerville; Craig H. Cooley, Bountiful, both of Utah

[73] Assignee: Baker Hughes Incorporated, Houston, Tex.

[21] Appl. No.: 08/853,724

[22] Filed: May 9, 1997

Related U.S. Application Data

[63] Continuation-in-part of application No. 08/407,384, Mar. 17, 1995, Pat. No. 5,651,420.

[51] Int. Cl.[6] ..... E21B 4/00; E21B 10/04

[52] U.S. Cl. ..... 175/102; 175/404

[58] Field of Search ..... 175/102, 404, 175/426, 428, 429

[56] References Cited

U.S. PATENT DOCUMENTS

| | | | |
|---|---|---|---|
| 2,084,096 | 6/1937 | Lewis . | |
| 2,727,729 | 12/1955 | Boice . | |
| 2,819,041 | 1/1958 | Beckham . | |
| 3,726,351 | 4/1973 | Williams, Jr. | 175/426 |
| 3,943,997 | 3/1976 | Davis . | |
| 4,105,083 | 8/1978 | Allen . | |
| 4,114,705 | 9/1978 | Milan . | |
| 4,116,289 | 9/1978 | Feenstra . | |
| 4,186,808 | 2/1980 | Cox . | |
| 4,253,533 | 3/1981 | Baker, III . | |
| 4,368,787 | 1/1983 | Messenger . | |
| 4,373,592 | 2/1983 | Dellinger et al. . | |
| 4,540,055 | 9/1985 | Drummond et al. . | |
| 4,673,045 | 6/1987 | McCullough . | |
| 4,727,946 | 3/1988 | Barr et al. . | |
| 4,739,845 | 4/1988 | Dennis . | |
| 4,744,426 | 5/1988 | Reed . | |
| 4,883,132 | 11/1989 | Tibbitts . | |
| 4,913,244 | 4/1990 | Trujillo . | |
| 5,002,139 | 3/1991 | Haussmann et al. . | |
| 5,143,162 | 9/1992 | Lyon et al. . | |
| 5,199,511 | 4/1993 | Tibbitts et al. . | |
| 5,447,208 | 9/1995 | Lund et al. | 175/428 |
| 5,582,258 | 12/1996 | Tibbitts et al. | 175/429 X |

FOREIGN PATENT DOCUMENTS

| | | |
|---|---|---|
| 2181173 | 4/1987 | United Kingdom . |

*Primary Examiner*—Frank Tsay
*Attorney, Agent, or Firm*—Trask, Britt & Rossa

[57] ABSTRACT

A drilling apparatus having cuttings removal structure to reduce balling thereof and to help prevent the accretion of portions of chips and debris from drilling thereon and/or the accretion of portions of drilling fluids thereon. The drilling apparatus comprises an apparatus body having a connection thereon and structure for contacting cut portions of the earth formation. The contacting structure may include chip breakers and flails or combinations thereof.

24 Claims, 8 Drawing Sheets

DRILLING APPARATUS WITH DYNAMIC CUTTINGS REMOVAL AND CLEANING

This application is a continuation-in-part of patent application Ser. No. 08/407,384, filed Mar. 17, 1995, entitled "DRILLING APPARATUS WITH DYNAMIC CUTTINGS REMOVAL AND CLEANING", now U.S. Pat. No. 5,651,420.

BACKGROUND OF THE INVENTION

1.Field of the Invention

This invention relates to improvements for drill bits, the improvements having the ability to break cuttings produced from drilling operations and to prevent or remove cuttings or drilling fluid solid material accretion on such drill bits. More specifically, this invention relates to drill bits having the dynamic capability, either mechanical, hydraulic or both, to break drill cuttings produced from the formations being drilled into smaller, more easily transported cuttings in the drilling fluids, to remove the drilled material and/or solids therefrom or to prevent accretion of material or solids thereon. The invention is particularly useful with drill bits used in either plastic and sticky rock formations or formations and drilling fluids which tend to build up or accrete on the bits.

2. State of the Art

The clogging of the various fluid courses, surfaces and cavities of drilling accessories, drill bits and the like by the highly ductile cuttings produced from drilling operations in plastic formations, or solids from the formations, or solids from the drilling fluid, is typically referred to as "balling," or "bit balling", if it is a drill bit. The drilling of shales or other plastic types of rock formations has always been difficult for all types of downhole drill bits and particularly when using drag type drill bits. The shales, when under pressure and in contact with drilling fluids, tend to act as a sticky mass, and tend to ball or clog cutting surfaces and cavities of the drill bit, thereby reducing the bit's cutting effectiveness. Other formations, when contacted with particular types of drilling fluid systems, can also cause severe balling problems by the drilling fluid system enhancing or enabling the cuttings from the formation to accrete on the drill bit and drilling accessories.

Also, certain types of formations being drilled when subjected to high hydrostatic drilling fluid pressure, such as hydrostatic drilling fluid pressure generated by highly weighted drilling fluids used at great depths, are highly plastic, generating long, ductile cuttings during drilling operations. Unless such cuttings are effectively broken into more manageable, smaller cuttings, the various fluid courses, surfaces and cavities of the drill bit and drilling accessories become clogged, thereby reducing their effectiveness.

One typical prior art approach which deals with such a drag bit balling problem has been to provide large cutters on the bit with strong drilling fluid hydraulics in the proximity of the cutters in an attempt to remove the cuttings from the cutter faces with high-volume, high-velocity hydraulic jet flow of the drilling fluids. For example, see U.S. Pat. No. 4,116,289.

Another prior art attempt to deal with such drag bit balling problem is illustrated in UK Patent GB 2181173A, to Barr et al., entitled "Improvements In or Relating to Rotary Drill Bits." It illustrates a bladed drag bit with a plurality of cutters on each blade in combination with a nozzle which creates a vortex flow having a peripheral stream extending across the cutting elements and exiting into a gage region of the bit. The cutters are shown in a spaced relationship and a nozzle is azimuthally disposed in front of each blade. The flow from each nozzle is isolated from the flow of other nozzles on the bit by the solid mass of the adjacent blades. This tends to cause isolation of the hydraulics of each vortex pattern, presents a non-cutting bit surface between the cutters to the sticky formation, and does not provide for a directed hydraulic impingement on the chips, which impingement has a tendency to peel the adhered chips from the cutter faces.

Yet another prior art drag bit for cutting plastic rock formations comprises a plurality of large polycrystalline diamond cutters with each large cutter having a nozzle directing the flow of drilling fluids to each large cutter to apply a force to the chip which is cut by the large cutter. The force tends to peel the chip from the face of the large cutter thereby minimizing the tendency of the bit to ball. Such a bit is illustrated in U.S. Pat. No. 4,913,244.

Still another prior art drag bit for drilling shales and sticky formations comprises a bit body, a plurality of blades formed with the bit body extending therefrom, and at least one cutting element, preferably a plurality of cutters, on each blade. Each cutter has a diamond cutting face to reduce the probability of adhesive contact between the cutters and the plastic, sticky rock formations. Each blade defines a cavity between the blade and the body of the bit, thereby permitting the flow of material therethrough. In this manner, hydraulic removal of cuttings is enhanced to avoid bit bailing. To further enhance the hydraulic fluid flow across the bit, one or more nozzles are disposed in the bit body below each of the blades to direct the hydraulic flow of drilling fluids across the cavity and the plurality of cutters disposed on the corresponding blade. Preferably, each nozzle is disposed in the bit body behind the diamond faces of the corresponding plurality of cutters on a blade with respect to the direction of normal rotation of the bit during drilling. In this manner, the chip being sheared from the formation being drilled extrudes upwardly across the diamond face of the cutter to be caught at the upper edge of the cutter by the hydraulic flow from a nozzle located behind the cutter to effectively peel away the chip from the diamond face into the various waterways and junk slots of the bit. Such a bit is illustrated in U.S. Pat. No. 4,883,132.

While such bits may be effective in the drilling of shales and sticky, plastic rock formations, bit balling may still be a problem in some instances as the bit hydraulic flow may not effectively deal with chip removal from the cutter faces of the bit. In some instances, the hydraulic flow may not be sufficient to peel the chips off the cutter faces, may not be sufficient to break the chips after leaving the cutter faces, or may not be sufficient to cause the removal of large chips, or the instantaneous removal of a high volume of chips, from the waterways, face junk slots and junk slots of the bit during drilling operations.

In other instances, the adhesion properties of the components of various drilling fluid systems are sufficient to cause accretion of the drilling fluid solids and attendant formation cuttings on the drill bit surfaces, thereby affecting the drilling performance of the bit drilling tools and initiation of bit balling. These problems can similarly affect the performance of drilling accessories used in drilling operations.

Another prior art drill bit illustrated in U.S. Pat. No. 4,727,946 utilizes brush-like rubbing pads having a plurality of bristles to provide sealing around the nozzles of the bit face and channel the drilling fluid from the nozzles past the cutting elements of the bit to help clean the cutting elements.

A drill bit described in U.S. Pat. No. 5,199,511 utilizes an expanding pad to sealingly engage the side of the borehole to seal freshly cut portions of the bottom of the borehole from drilling fluids. The expanding pad of the bit body is formed of an elastomeric material which is reinforced with wire or other reinforcing material and which may have an abrasion-resistant grit embedded therein and/or abrasion resistant pad thereon.

A downhole tool described in U.S. Pat. No. 4,744,426 is positioned intermediate the mud motor and drill bit to reduce the hydrostatic pressure of the drilling fluid column near or around the drill bit by pumping the drilling fluid up the annulus between the drill pipe string and the borehole in an attempt to increase bit penetration rate of the formation. A multi-vane fan contained within a portion of the downhole tool is used to pump the drilling fluid up the annulus.

SUMMARY OF THE INVENTION

The present invention relates to drill bits and the like having the dynamic capability to break cuttings produced from drilling operations and to help prevent the accretion of material from either the drilling fluids or the formation being drilled, or both, on the surfaces of such drill bits.

The present invention as it relates to a drill bit comprises a bit body having a connection at the upper end and a fluid passageway through the bit, and chip and debris breaking apparatus associated with the bit for contacting cut portions of the earth formation to cause the cut portions to be broken and removed from the bit body and prevent accretion thereon to prevent balling of the bit, as well as to prevent the accretion of solids from the drilling fluid on the bit body. The chip and debris breaking apparatus comprises driven assemblies, where the driven assembly breaks the chips, clears accretion of solids from the drilling fluids or combinations thereof.

Mechanical flails may also be used in conjunction with the driven assemblies to break chips and debris, clear accretion of solids from the drilling fluids or combinations thereof.

The drill bit of the present invention provides for having a chip and debris breaking apparatus thereon, and may be used with either a downhole drill motor or a conventional drill pipe string rotated by a rotary table or top drive assembly on a drilling rig.

The present invention will be better understood when the drawings are taken in conjunction with the description of the invention set forth hereafter.

DETAILED DESCRIPTION OF THE ILLUSTRATED EMBODIMENT

Figure 1:
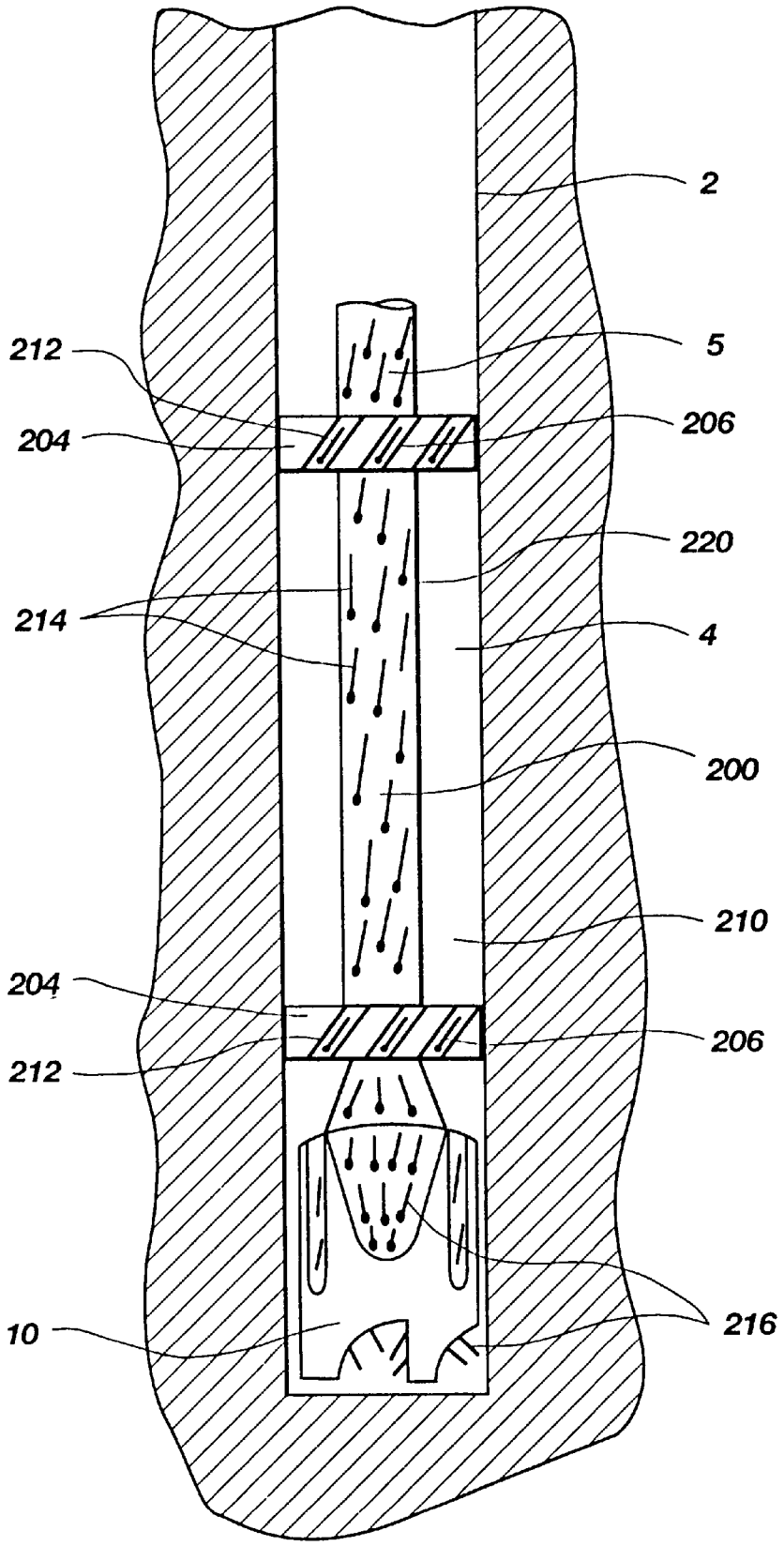
FIG. 1 is a drawing of a drill string having the drill bit and chip breaker drive assembly of the present invention used in a drill string.

Referring to drawing FIG. 1, the drill bit 10 of the present invention is shown being used on a drill string.

As shown, a drill bit 10 is drilling a borehole 2 through a formation. The drill bit 10 is connected to the lower end of a drill string 4. The drill string 4, comprised of a series of drill pipe and/or drill collars 5, includes, at the lower end thereof, a downhole drill motor 200 having, if desired, a plurality of stabilizers 204 located thereon or connected thereto. Each stabilizer 204 is a generally cylindrical annular member connected to a drill collar 5 in the drill string 4. The stabilizer 204 comprises a series of fluid courses or passages 206 on the exterior thereof to allow the flow of drilling fluid and chips and debris contained therein to flow upwardly past the stabilizer 204 in the borehole 2 in the annular space 210 between the drill string 4 and borehole 2. Contained in each fluid passageway 206 of each stabilizer 204 is one or more flails 212 of any suitable type described herein to prevent the clogging of the passageway 206 by the chips and debris from the drilling operation and/or solids from the drilling fluid being used in the drilling operation. Similarly, a plurality of flails 214 is secured to the exterior of the downhole drill motor 200 to prevent the accretion of chips and debris from the drilling operation and/or solids from the drilling fluid thereon. The flails 212 and 214 may be secured to the stabilizers 204 and drill motor 200 by many suitable means as described herein. Also, as shown, the drill bit 10 includes a plurality of flails 216 located thereon to break chips formed during the drilling operation and to prevent the accretion of chips and debris from the drilling operation and/or solids from the drilling fluid on the bit. In this manner, the portion of the drill string 4 located near the bit 10 during drilling operations may be used to break chips formed during drilling operations, keeping it relatively free of material buildup and thereby increasing the effectiveness of the drilling operation.

Alternatively, rather than having flails 214 located on a downhole drill motor 200 located between two stabilizers 204 in a drill string 4, the flails 214 may be located on the exterior of a downhole motor 200 connected to drill bit 10 having stabilizers 204 located above the bit and/or the motor 200, if desired.

Figure 2:
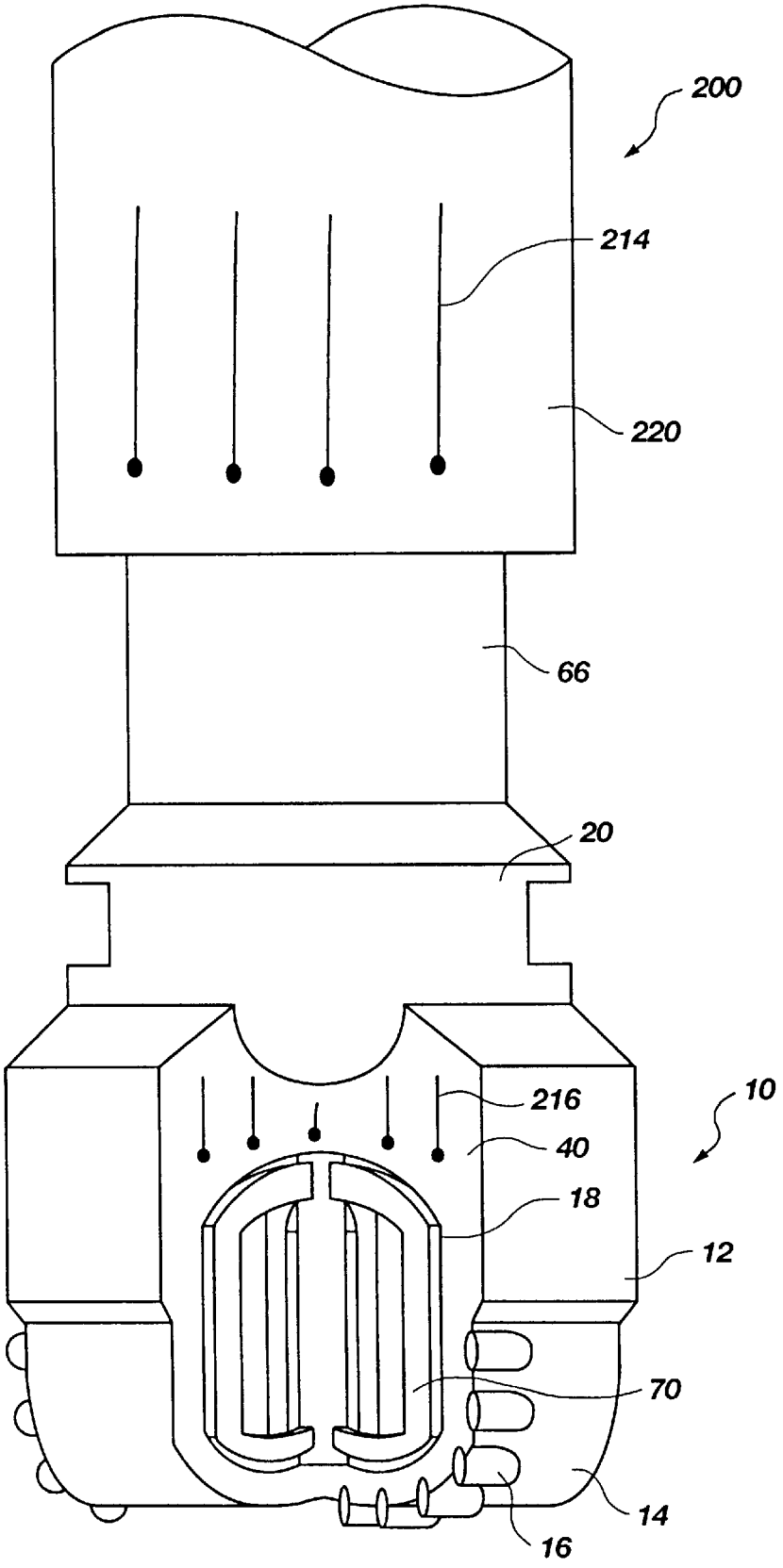
FIG. 2 is a drawing of a bit having a first embodiment of the drill bit and chip breaker drive assembly of the present invention connected to a down hole drill motor in a drill string.

Referring to drawing FIG. 2, drill bit 10 having a threaded pin connector 20 connected to a portion 66 of a chip breaker drive assembly 50 (shown in FIG. 3), a plurality of cutters 16 located on bit blade 14, a plurality of tethered type flexible flails 216 located on the bit 10, and a movable chip breaker 70 located within cavity 18 of the bit 10. The flails 216 are secured to the bit 10 in various desired areas to be displaced by the flow of the drilling fluid to prevent chips and cuttings from the formations being drilled, and/or mud solids from drilling fluids, from building up on the bit 10.

Also shown on drilling motor 200 is a plurality of flails 214. The flails 214 may be of any suitable material, such as metal cable, chain, spring wire, plastic, polymeric materials, etc., and may be secured at one end thereof by any suitable means, such as welding, brazing, adhesion, mechanical attachment, etc. If desired, the flails 214 may include suitable members, such as weighted balls, washers with spikes thereon, twisted members, kinked members, spirally wound members, etc., to aid in preventing the buildup of cuttings on the bit 10 and to assist in breaking up the formation chips and cuttings formed during drilling operations and the accretion of drilling fluid solids on the bit body. The flails 214 or 216 may be of the type illustrated and described in U.S. patent application Ser. No. 08/407,384, filed Mar. 17, 1995, entitled "Drilling Apparatus With Dynamic Cuttings Removal and Cleaning", now U.S. Pat. No. 5,651,420 which is hereby incorporated by reference.

Figure 3:
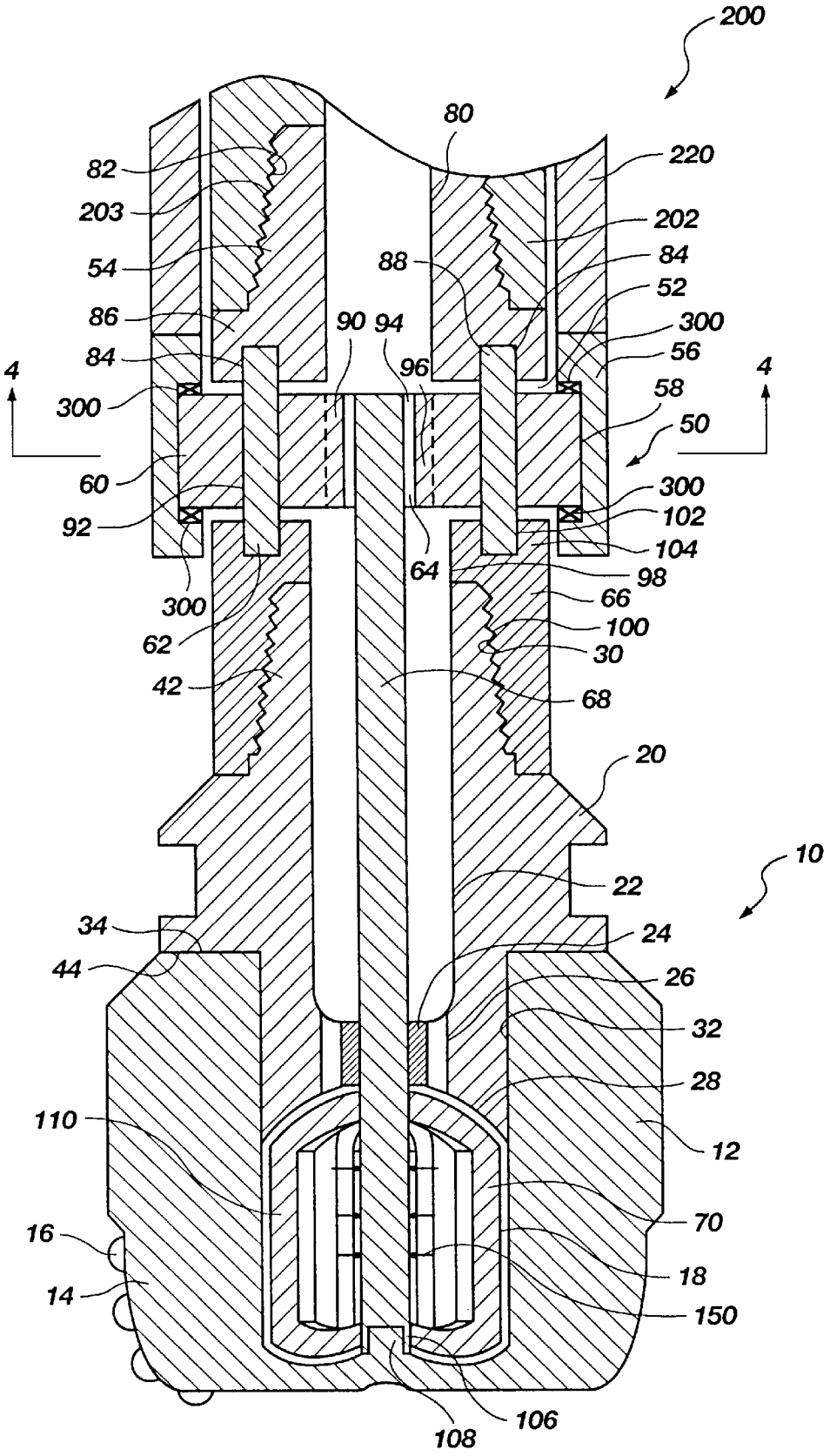
FIG. 3 is a cross sectional view of the bit having a first embodiment of the present invention connected to a drill motor in a drill string shown in FIG. 2.

Referring to drawing FIG. 3, the first embodiment of the drill bit 10 and chip breaker drive assembly 50 of the present invention is shown. The first embodiment of the present invention comprises an assembly including a drill bit 10, a drill motor 200, and a chip breaker drive assembly 50.

As illustrated, the drill motor 200 may be of any suitable type which includes a drive shaft 202 and a drill motor housing 220.

The drill bit 10, suitable for use in the present invention, includes a bit body 12 and a pin connector 20 connected to the bit body.

The bit body 12 comprises a generally cylindrical member having one or more blades 14 thereon, each blade 14 having one or more cutters 16 thereon, and a generally cylindrical elongated cavity 18 therein having a protrusion 106 at the bottom thereof. The bit body 12 may include one or more fluid courses or junk slots 40 therein (see FIG. 2). It is understood that the bit body 12 has been described hereinabove in an exemplary manner and may be of any suitable configuration.

The pin connector 20 comprises a generally cylindrical member having a first bore 22 therein, a second bore 24 therein, one or more fluid passageways 26 therein allowing fluid communication between the first bore 22 and the bottom end 28 of the pin connector 20, threaded pin connector portion 30 on the upper end 42 of the pin connector 20, lower exterior surface 32 thereon which mates with cavity 18 of the bit body 12, and shoulder 34 which abuts an upper surface 44 of the bit body 12. The lower end 28 of the pin connector 20 may be of any suitable shape to form the upper part or wall of the cavity 18 of the bit body 12 when the bit body 12 and pin connector 20 are assembled. It is understood that the pin connector 20 has been described hereinabove in an exemplary manner and may be of suitable configuration.

The bit body 12 and the pin connector 20 may be secured to each other by any suitable means, such as brazing, welding, interference fit, etc., suitable for use in a well drilling environment in any type well.

The chip breaker drive assembly 50 comprises planet carrier assembly 52, drive shaft 68 and chip and debris breaker 70.

The planet carrier assembly 52 includes upper carrier connector support 54, stationary ring gear housing 56, planet drive gears 60, planet drive shafts 62, sun gear 64, and lower carrier connector support 66.

The upper carrier connector support 54 comprises an elongated annular member having a bore 80 therethrough, pin type threaded exterior surface 82 thereon which threadably, releasably engages threaded box type connecting surface 203 of drive shaft 202 of drill motor 200, and a plurality of apertures 84 in the lower end 86 of the upper carrier connector support 54, each aperture receiving an end 88 of a planet drive shaft 62 therein. The planet drive shafts 62 may be secured in apertures 84 of upper carrier connector support 54 by any suitable means, such as interference fit, brazing, welding, etc.

The stationary ring gear housing 56 comprises a generally annular member having an internal gear track 58, having a plurality of teeth therein which mates with each planet drive gear 60, and having an exterior surface having, in turn, a diameter compatible to the diameter of the housing 220 of the drill motor 200. The stationary ring gear housing 56 may be secured to the housing 220 of the drill motor by any suitable means, such as welding, brazing, threaded connection, threaded connection using a threaded collar, etc.

The planet drive gears 60 each comprise annular cylindrical members having a plurality of teeth 90 thereon which engage the teeth in the gear track 58 of the stationary ring gear housing 56 and bore 92 through which a planet drive shaft 62 passes to rotatably support each planet drive gear 60 in the chip breaker drive assembly 50.

Each planet drive shaft 62 comprises an elongated generally cylindrical member. Each planet drive shaft 62 is retained in the chip breaker drive assembly 50 by the ends of the shaft 62 engaging the upper carrier connector support 54 and the lower carrier connector support 66 while each shaft 62 passes through bore 92 of a planet drive gear 60.

The sun gear 64 comprises an annular member having a bore 94 therethrough and a plurality of teeth 96 thereon which engage teeth 90 on a planet drive gear 60. The sun gear 64 may be of any size compatible with the chip breaker drive assembly 50. However, it is preferred that the mechanical gear relationship between the planet drive gears 60 and the sun gear 64 be such that the sun gear 64 rotates two (2) to five (5) times the speed in revolutions per minute (RPM) in comparison to that of the rotation of the drill bit 10 in revolutions per minute (RPM) which is driven by the planet drive gears 60 being connected to the drill bit 10 via shafts 62 and lower carrier connector support 66 engaging pin connector 20 of the drill bit 10 and the upper carrier connector support 54 which is, in turn, connected to the drive shaft 202 of the drill motor 200.

The lower carrier connector support 66 comprises a generally annular cylindrical member having a cylindrical bore 98 therein, threaded box connector 100 therein which threadably, releasably engages with threaded pin connector portion 30 of pin connector 20 of drill bit 10, and a plurality of apertures 102 in end portion 104 of the lower carrier connector support 66, each aperture 102 receiving an end portion of a planet drive shaft 62 therein. The planet drive shafts 62 may be secured in apertures 102 of lower carrier connector support 66 by any suitable means, such as interference fit, brazing, welding, etc.

The drive shaft 68 comprises an elongated, generally cylindrical member having the upper end thereof connected to the sun gear 64 via the bore 94 therein and an aperture 106 in the lower end thereof which rotatably engages protrusion 108 in the bit body 10 located at the bottom of the cavity 18 therein. The connection between the drive shaft 68 and sun gear 64 may be made by any suitable means, such as interference fit, welding, brazing, threaded connection splined connection etc. The drive shaft 68 extends through second bore 24 of the pin connector 20 of the drill bit 10 being generally supported during the rotation of the shaft 68 by the pin connector 20.

The chip breaker 70 comprises one or more generally u-shaped members 110 secured to the drive shaft 68. The u-shaped members 110 may be integrally formed with drive shaft 68 or may be secured thereto by any suitable means, such as welding, brazing, threaded connectors, rivets, etc. Any desired number of u-shaped members 110 may be attached to the drive shaft 68 depending upon the size and geometry of the cavity 18 in the bit body 12. If desired, one or more flails 150 may be attached to the shaft 68 to help break chips and debris from the drilling of the borehole 2 and to help prevent accretion of portions of chips and debris and portions of drilling fluid in the cavity 18.

If desired, suitable well known radial and thrust bearings 300 may be used in the stationary ring gear housing 56 for the drive planet gears 60 to engage. Such radial and thrust bearings 300 have been schematically illustrated as they are of varying, well known, suitable configurations as well as are sealed to prevent the ingress of drilling mud and formation debris therein.

Figure 4:
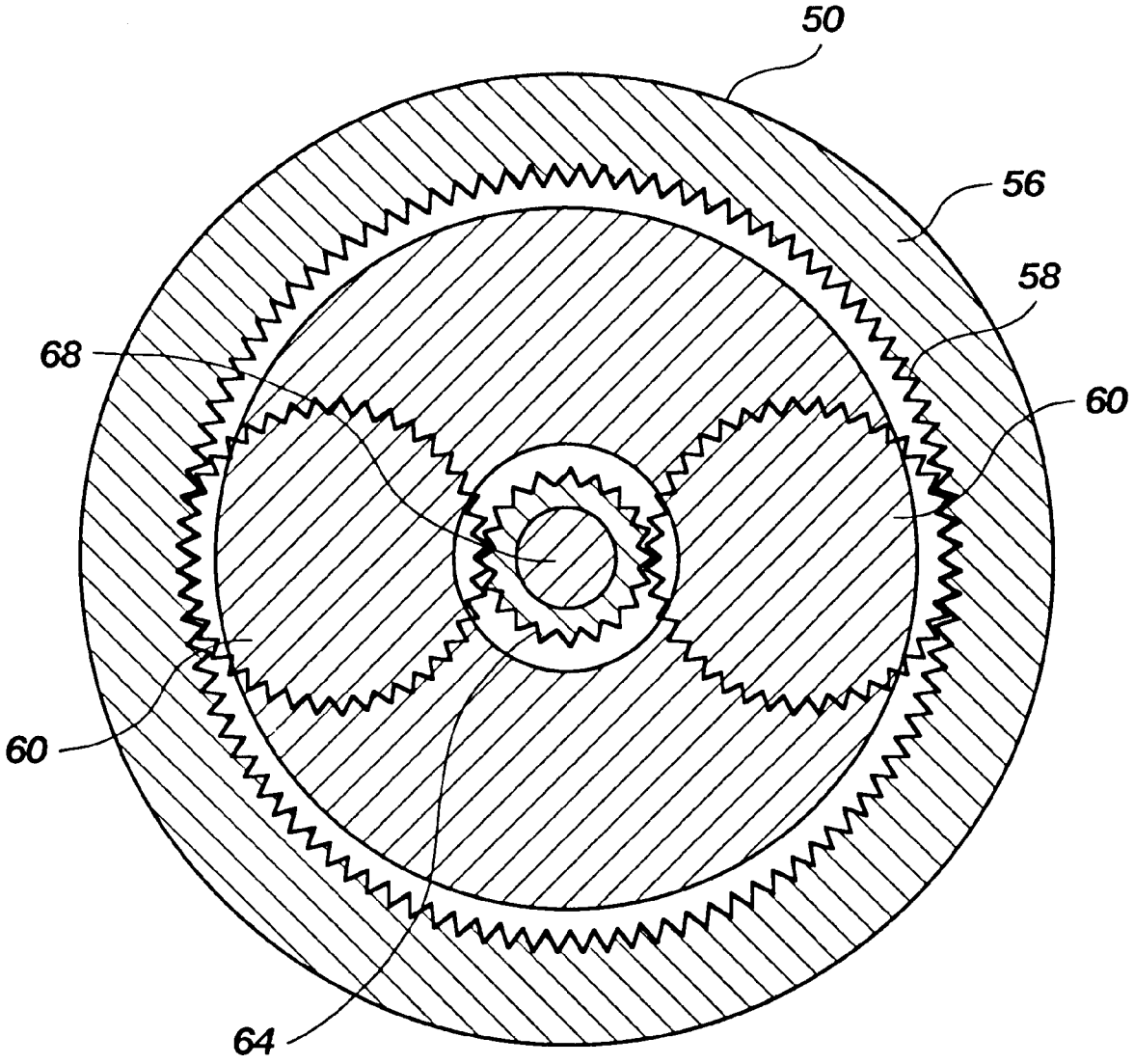
FIG. 4 is a cross sectional view taken along line 4—4 of FIG. 3.

Referring to drawing FIG. 4, the chip breaker drive assembly 50 is shown in cross section. As illustrated, the gear track 58 of stationary ring gear housing 56 engages planet drive gears 60 mounted on planet drive shafts 62 which, in turn, engage sun gear 64 connected to drive shaft 68. Although two planet drive gears 60 have been illustrated, any number may be used depending upon the amount of power required to drive the chip breaker 70.

Figure 5:
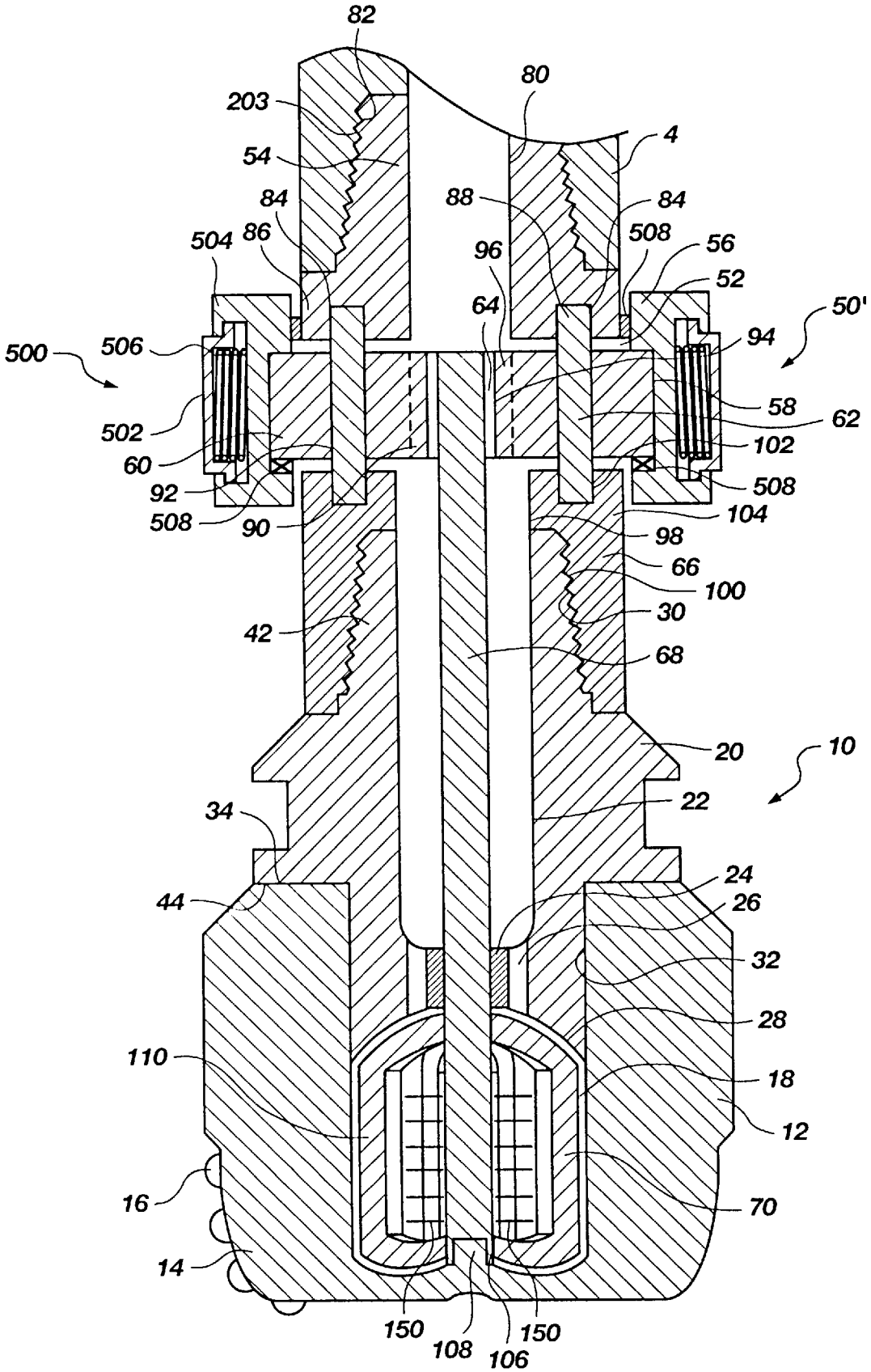
FIG. 5 is a cross sectional view of a second embodiment of the drill bit and chip breaker drive assembly of the present invention connected to a drill pipe string.

Referring to drawing FIG. 5, a second alternative embodiment of the drill bit 10 and chip breaker drive assembly 50' is shown. As illustrated, the chip breaker drive assembly 50' is connected to the drill collar and/or drill string 4 or drive shaft of a downhole motor, such as 202 shown in drawing FIG. 4, by means of upper carrier connector support 54 of the chip breaker drive assembly 50'. The chip breaker drive assembly 50' comprises planet carrier assembly 52, drive shaft 68 and chip and debris breaker 70.

The planet carrier assembly 52 includes upper carrier connector support 54, stationary ring gear housing 56, planet drive gears 60, planet drive shafts 62, sun gear 64, lower connector carrier support 66, drive shaft 68, and chip and debris breaker 70.

The upper carrier connector support 54 comprises an elongated annular member having a bore 80 therethrough, pin type threaded exterior surface 82 thereon which threadably, releasably engages threaded box type connection surface 203 of drill shaft 202, and a plurality of apertures 84 in the lower end 86 of the upper carrier connector support 54, each aperture receiving an end 88 of a planet drive shaft 62 therein. The planet drive shafts 62 may be secured in apertures 84 of upper carrier connector support 54 by any suitable means, such as interference fit, brazing, welding, etc.

The stationary ring gear housing 56 comprises a generally annular member having an internal gear track 58, having a plurality of teeth therein which mates with planet drive gears 60 and an exterior surface having a diameter compatible with the diameter of drill bit 10. The stationary ring gear housing 56 contains a plurality of suitable drag block assemblies 500 thereon. Each drag block assembly 500 includes drag block 502 resiliently retained within drag block retainer 504 by a plurality of springs 506. The drag block 502, drag block retainer 504, and springs may be any suitable conventional design, such as those used on open hole well packers. When the drag blocks 502 are in their extended position within drag block assemblies, the drag blocks 502 should extend beyond the diameter of the drill bit 10 with which they are being used so that when in use, the drag blocks 502 of the drag block assemblies 500 engage the borehole 2 being drilled by the drill bit 10 to keep the stationary ring gear housing 56 substantially stationary and free from rotation in the borehole 2, thereby causing the planet drive gears 60 to rotatably drive the sun gear 64 to, in turn, cause the rotation of drive shaft 68 and chip breaker 70 connected thereto. If desired, suitable well known radial and thrust bearing members 508 may be installed between upper carrier connector support 54 and stationary ring gear housing 56 and between stationary ring gear housing 56 and planet drive gears 60 to transfer thrust forces from the upper carrier connector support 54 to the stationary ring gear housing 56 and drag block assemblies 500 and a portion of the forces from the drill bit 10 to the stationary ring gear housing 56.

The planet drive gears 60 each comprise annular cylindrical members having a plurality of teeth 90 thereon which engage the teeth in the internal gear track 58 and bore 92 through which planet drive shaft 62 passes to rotatably support each planet drive gear 60 in the chip breaker drive assembly 50'.

Each planet drive shaft 62 comprises an elongated, generally cylindrical member. Each planet drive shaft 62 is retained in the chip breaker drive assembly 50' by the ends of the shaft 62 engaging the upper carrier connector support 54 and the lower carrier connector support 66 while each shaft 62 passes through bore 92 of a planet drive gear 60.

The sun gear 64 comprises an annular member having a bore 94 therethrough and a plurality of teeth 96 thereon which engage teeth 90 on a planet drive gear 60. The sun gear 64 may be of any size compatible with the chip breaker drive assembly 50'. However, it is preferred that the mechanical gear relationship between the planet drive gears 60 and the sun gear 64 be such that the sun gear 64 rotates two (2) to five (5) times the speed in revolutions per minute (RPM) in comparison to that of the rotation of the drill bit 10 in revolutions per minute (RPM) which is driven by the planet drive gears 60 being connected to the drill bit 10 via shafts 62 and lower connector carrier support 66 engaging pin connector 20 of the drill bit 10 and the upper carrier connector support 54 engaging the drill collar or drill string 4.

The lower carrier connector support 66 comprises a generally annular cylindrical member having a cylindrical bore 98 therein, threaded box connector 100 therein which threadably, releasably engages with threaded pin connector portion 30 of pin connector 20, and a plurality of apertures 102 in end portion 104 of the lower carrier connector support 66, each aperture 102 receiving an end portion of a planet drive shaft 62 therein. The planet drive shafts 62 may be secured in apertures 102 of lower carrier connector support 66 by any suitable means, such as interference fit, brazing, welding, etc.

The drive shaft 68 comprises an elongated, generally cylindrical member having the upper end thereof connected to the sun gear 64 via the bore 94 therein and an aperture 106 in the lower end thereof which rotatably engages protrusion 108 in the bit body 10 located at the bottom of the cavity 18 therein. The connection between the drive shaft 68 and sun gear 64 may be made by any suitable means, such as interference fit, welding, brazing, threaded connection, splinted connection, etc. The drive shaft 68 extends through second bore 24 of the pin connector 20 of the drill bit 10 being generally supported during the rotation of the shaft 68 by the pin connector 20.

The chip breaker 70 comprises one or more generally u-shaped members 110 secured to the drive shaft 68. The u-shaped members 110 may be integrally formed with drive shaft 68 or may be secured thereto by any suitable means, such as welding, brazing, threaded connectors, rivets, etc. Any desired number of u-shaped members 110 may be attached to the drive shaft 68 depending upon the size and geometry of the cavity 18 in the bit body 12. If desired, one or more flails 150 may be attached to the shaft 68 to help break chips and debris from the drilling of the bore hole 2 and to help prevent accretion of portions of chips and debris and portions of drilling fluid in the cavity 18.

Figure 6:
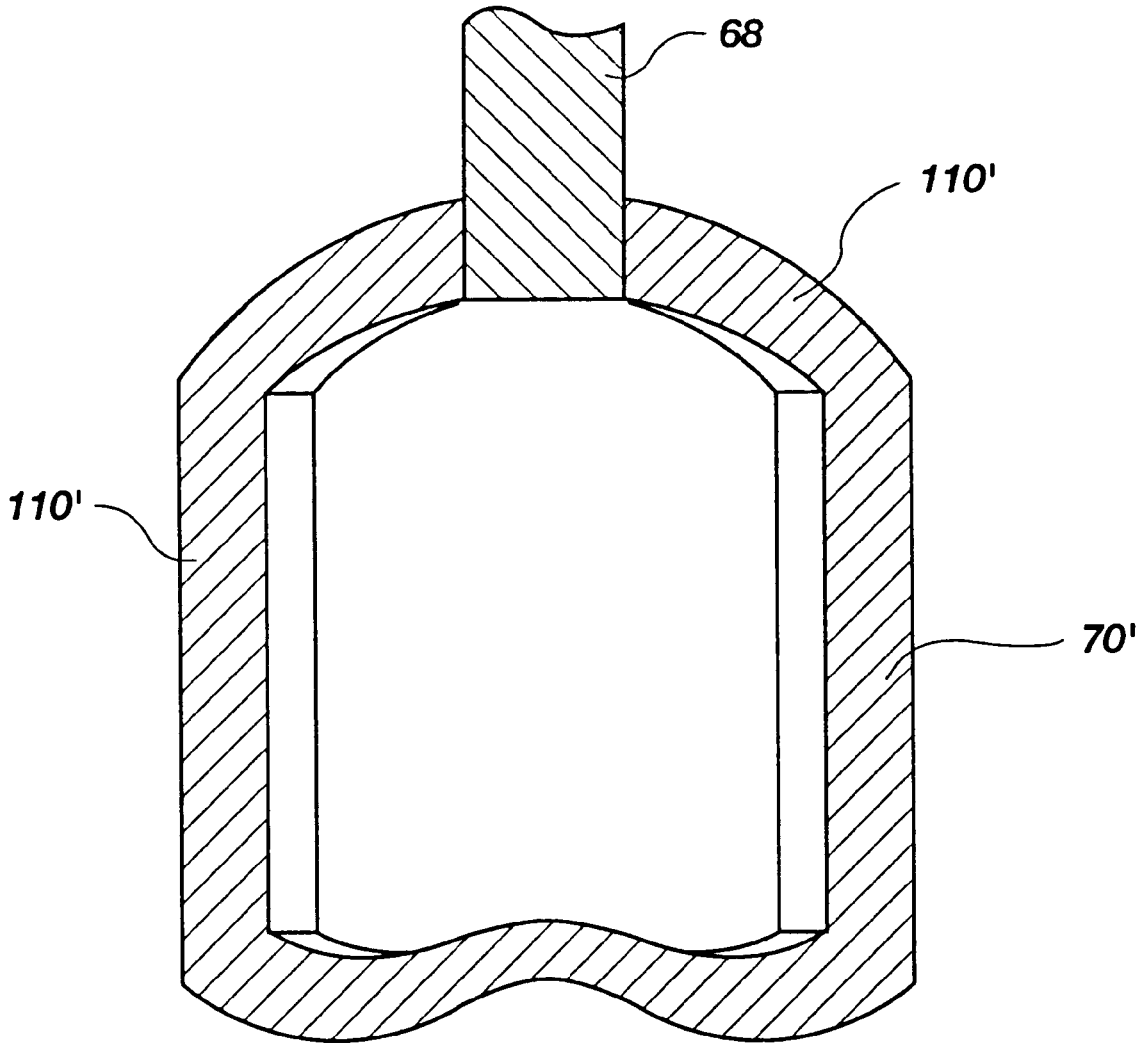
FIG. 6 is a view of the mechanical breaker portion used in the drill bit of either the first or second embodiment of the present invention.

Referring to drawing FIG. 6, an alternative embodiment chip breaker 70' is illustrated. The chip breaker 70' includes one or more u-shaped breaker members 110' connected to each other and to the end of drive shaft 68. In this manner, the u-shaped breaker members 110' may form a cage at the end of drive shaft 68 to rotate within cavity 18 of the bit body 12.

Figure 7:
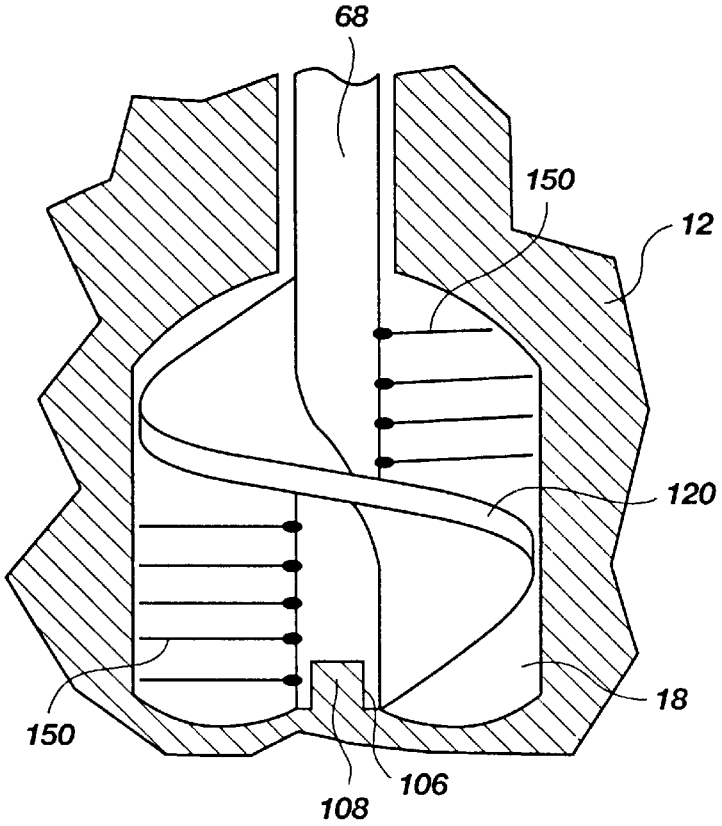
FIG. 7 is another view of the mechanical breaker portion used in the drill bit of either the first or second embodiment of the present invention.

Referring to drawing FIG. 7, another embodiment 120 of the chip breaker of the present invention is illustrated. As shown, the chip breaker 120 of the present invention comprises a helical or spirally shaped member attached to the end of drive shaft 68 and rotates within cavity 18 of bit body 12. The drive shaft 68 may also include one or more flails 150 secured thereto to help improve chip and debris breaking during the drilling process.

Figure 8:
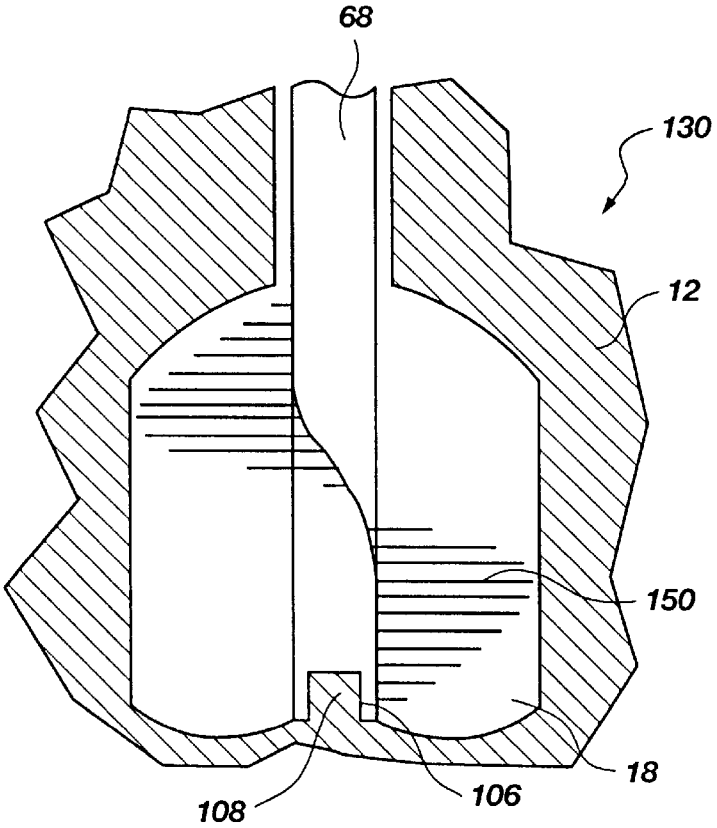
FIG. 8 is a view of the mechanical breaker portion used in the drill bit of either the first or second embodiment of the present invention wherein the mechanical breaker portion includes a helical spiral of flails.

Referring to drawing FIG. 8, another embodiment 130 of the chip breaker of the present invention is illustrated. As shown, the chip breaker 130 of the present invention comprises a helical or spirally shaped series of flails 150 attached to the drive shaft 68 and rotates within cavity 18 of bit body 12. The drive shaft 68 may include any desired number of flails 150 secured thereto to help improve chip and debris breaking during the drilling process. The flails 150 may be secured to the drive shaft 68 by any suitable well known manner.

Figure 9:
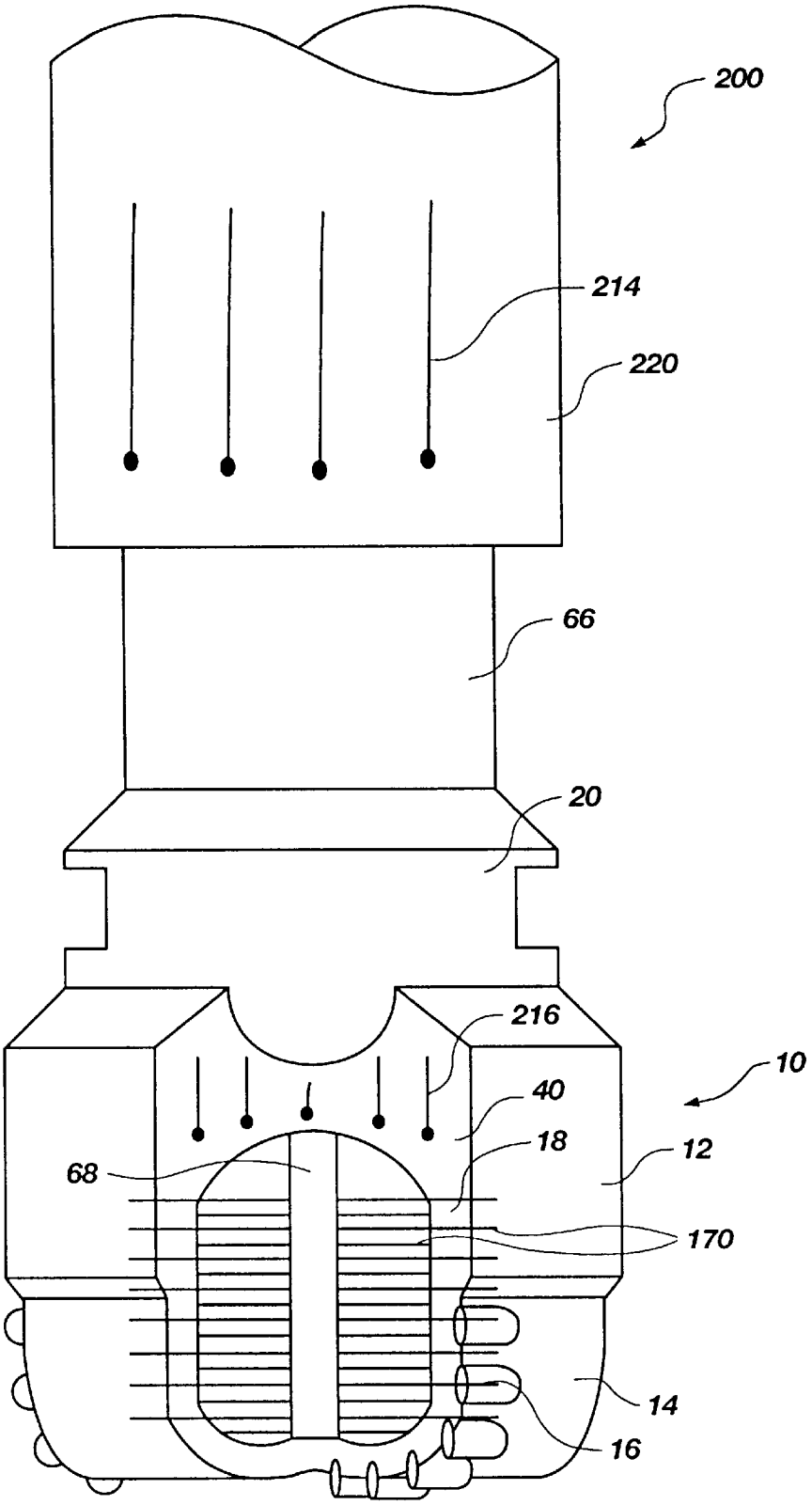
FIG. 9 is a drawing of a bit having a first embodiment of the drill bit and chip breaker drive assembly of the present invention connected to a downhole drill motor in a drill string wherein the mechanical breaker includes a plurality of flails.

Referring to drawing FIG. 9, drill bit 10 having a threaded pin connector 20 connected to a lower carrier connection support 66 of a chip breaker drive assembly 50 (shown in FIG. 3), a plurality of cutters 16 located on bit blade 14, a plurality of tethered type flexible flails 216 located on the bit 10, and a plurality of flails 170 connected to drive shaft 68 located within cavity 18 of the drill bit 10. The flails 170 secured to the drive shaft 68 may be any well known suitable type, such as spring steel wire type, cable type, etc., to clean the cavity 18 in the drill bit 10 and are of sufficient, length to extend beyond the largest diameter of the drill bit 10 to engage the borehole formed by the drill bit 10. As the flails 170 are rotated by the drive shaft 68, the flails 170 are bent to engage the cavity 18 within the drill bit 10 and then extend beyond the drill bit 10 to engage the borehole formed thereby. Additionally, flails 216 are secured to the bit 10 in various desired areas to be displaced by the flow of the drilling fluid to prevent chips and cuttings from the formations being drilled, and/or mud solids from drilling fluids, from building up on the bit 10. Also shown on drilling motor 200 is a plurality of flails 214. The flails 214 may be of any suitable material, such as metal cable, chain, spring wire, plastic, polymeric materials, etc., and may be secured at one end thereof by any suitable means, such as welding, brazing, adhesion, mechanical attachment, etc. If desired, the flails 214 may include suitable members, such as weighted bails, washers with spikes thereon, twisted members, kinked members, spirally wound members, etc., to aid in preventing the buildup of cuttings on the bit 10 and to assist in breaking up the formation chips and cuttings formed during drilling operations and the accretion of drilling fluid solids on the bit body. The flails 170, 214, or 216 may be of the type illustrated and described in U.S. patent application Ser. No. 08/407,384, filed Mar. 17, 1995, entitled "Drilling Apparatus With Dynamic Cuttings Removal and Cleaning", now U.S. Pat. No. 5,651,420 which is hereby incorporated by reference.

OPERATION OF THE INVENTION

Referring to drawing FIGS. 1 through 3, a drill bit 10 is connected during a borehole 2 drilling process to a downhole drilling motor 200. The drillng motor 200 may be used with stabilizers 204 in the drill string 4. The drill bit 10, the drill motor 200, and the stabilizers 204 may include the use of flails 216, 214 and 212, respectively, thereon to break chips and debris produced during the drilling of the borehole 2 and to prevent the accretion of portions of the chips and debris and portions of drill fluids on the bit 10, drill motor 200, and stabilizers 204 during the drilling process.

During drilling operations using the present invention, the drive shaft 202 of the drill motor 200 is connected to the upper carrier connector support 54 of the chip breaker drive assembly 50 while the drill motor housing 220 is connected to the stationary ring gear housing 56 of the chip breaker drive assembly 50 and the lower carrier connector support 66 of the chip breaker drive assembly 50 is connected to the pin connector 20 of the drill bit 10.

When the drill motor 200 is operating, the drive shaft 202 rotates upper carrier connector support 54 while drilling fluid flows through bore 80 thereof. The upper carrier connector support 54, in turn, causes the rotation of planet drive gears 60 in the gear track 58 of stationary ring gear housing 56 and the planet drive shafts 62 having planet drive gears 60 located thereon and connected to the upper carrier connector support 54 and lower carrier connector support 66 cause the rotation of the lower carrier connector support 66 which is connected to the pin connector 20 of the drill bit 10, thereby causing rotation of the drill bit 10. At the same time, since the planet drive gears 60 engage sun gear 64, the planet drive gears cause the sun gear 64 to rotate which, in turn, causes the drive shaft 68 to rotate and the chip breaker 70 attached thereto to rotate, thereby breaking chips and debris generated during drilling by the drill bit 10 and helping to prevent the accretion of portions of the chips and debris generated during the drilling process and the accretion of portions of the drilling fluids on the drill bit 10. Further, during the operation of the drill motor 200, the chip breaker drive assembly 50 and the drill bit 10, the drilling fluid flows through the bore 80 of upper carrier connector support 54, through the area between the planet drive gears 60 and sun gear 64, through bore 98 of the lower carrier connector support 66, through first bore 22 of pin connector 20, through passageways 26 of pin connector 20, into the cavity 18 of drill bit 10 formed by the bit body 12 and pin connector 20, and from the cavity 18 into the borehole 2 being drilled by the drilling bit 10. In this manner, as the drill fluid flows upwardly along the exterior of the drill bit 10, the drill motor 200 and any stabilizers 204 the flails 216, 214, and 212, respectively, may break any chips and debris not broken by chip breaker 70 in the drill bit 10, and help prevent the accretion of portions of chips and debris and portions of the drilling fluid on the drill bit 10, drill motor 200 and stabilizers 204.

Referring to drawing FIGS. 1, 2, and 5, the operation of the drill bit 10 and chip breaker drive assembly 50' is similar to that described hereinabove, except that the chip breaker drive assembly 50' is driven by a drill collar and/or drill string 4 connected to the upper carrier connector portion 54 and the stationary gear housing 56 is held substantially stationary in the borehole 2 by the drag blocks 502 of the drag block assemblies 500 engaging the wall of the borehole 2.

Referring to drawing FIGS. 1, 2, and 9, the operation of the drill bit 10 and the chip breaker drive assembly 50 is similar to that described hereinabove, except that flails 170 are included to break chips and debris.

While the present invention has been described in relation to the various embodiments illustrated herein, it will be understood that various additions, deletions, changes and modifications may be made to the present invention which fall within the scope of the claims of the invention. For instance, any number of planet gears may be used, a variety of chip breaker configurations may be used, the manner in which the chip breaker drive assembly is connected to the drill motor may vary, etc.

What is claimed is:

1. A drilling apparatus used in a drill string for drilling a borehole in an earth formation, said drilling causing said earth formation to be broken or cut into chips and debris which are transported by a flow of drilling fluid in said borehole, said drilling apparatus comprising:

a drill bit having at least one connection structure thereon for connecting said bit in said drill string and an interior passage for said flow of said drilling fluid therethrough, said drill bit having a cavity therein contacted by said chips and debris transported by said flow of drilling fluid in said borehole;

movable apparatus contained within said cavity of said drill bit, said apparatus movable in said flow of said drilling fluid in said cavity to break said chips and debris and to prevent accretion of said chips and debris or portions of said drilling fluid in an exterior area surface of said drill bit; and drive apparatus having a portion thereof connected to a portion of said drill string and having a portion thereof connected to said movable apparatus, said drive apparatus thereby causing said movable apparatus to move within said drill bit.

2. The drilling apparatus of claim 1, wherein said cavity is an area formed by at least two opposed surfaces in said drill bit.

3. The drilling apparatus of claim 1, wherein said movable apparatus comprises:

a rotating chip breaker having a portion extending into said cavity in said drill bit.

4. The drilling apparatus of claim 3, wherein said movable apparatus comprises:

one or more movable members extending into said cavity in said drill bit, said movable apparatus secured to a portion of a shaft extending into said cavity in said drill bit.

5. The drilling apparatus of claim 1, wherein said drill string includes a drill motor having a portion thereof connected to said drive apparatus.

6. The drilling apparatus of claim 1, wherein said drill string includes a drill motor having a drive shaft and a housing; and said drive apparatus having a portion thereof connected to the drive shaft of said drill motor and a portion thereof connected to the housing of said drill motor.

7. The drilling apparatus of claim 1, wherein said drill string includes a drill motor having a drive shaft and a housing; and said drive apparatus includes a chip breaker drive assembly, said chip breaker drive assembly having a portion thereof connected to the drive shaft of said drill motor, a portion thereof connected to the housing of said drill motor, and a portion thereof connected to said drill bit.

8. The drilling apparatus of claim 1, wherein said drill string includes a drill motor having a drive shaft and a housing; and said drive apparatus includes a chip breaker drive assembly, said chip breaker drive assembly having a portion thereof connected to the drive shaft of said drill motor, a portion thereof connected to the housing of said drill motor, and a portion thereof connected to said drill bit, said chip breaker drive assembly including:

an upper carrier connector support connected to the drive shaft of said drill motor;

a stationary gear track connected to the housing of said drill motor;

at least one planet drive gear engaging a portion of the stationary gear track;

at least one planet drive shaft engaging the at least one planet drive gear and a portion of the upper carrier connector support;

a lower carrier connector support connected to the at least one connection structure of said drill bit and connected to the at least one planet drive shaft; and a sun gear having a portion thereof engaging a portion of the at least one planet drive gear and connected to said movable apparatus.

9. The drilling apparatus of claim 8, wherein said drive apparatus further includes:

a drive shaft connecting the sun gear to said movable apparatus, said movable apparatus including a chip breaker.

10. The drilling apparatus of claim 9, wherein said movable apparatus further includes:

a flail.

11. The drilling apparatus of claim 1, wherein said drill string includes a drill collar having a connection structure thereon; and said drive apparatus includes a chip breaker drive assembly, said chip breaker drive assembly having a portion thereof connected to the connection structure of said drill collar, a portion thereof engaging a portion of said borehole, and a portion thereof connected to said drill bit, said chip breaker drive assembly including:

an upper carrier connector support connected to the connection structure of said drill collar;

a stationary gear track having a portion thereof engaging a portion of said borehole;

at least one planet drive gear engaging a portion of the stationary gear track;

at least one planet drive shaft engaging the at least one planet drive gear and a portion of the upper carrier connector support;

a lower carrier connector support connected to the at least one connection structure of said drill bit and connected to the at least one planet drive shaft; and a sun gear having a portion thereof engaging a portion of the at least one planet drive gear and connected to said movable apparatus.

12. The drilling apparatus of claim 11, wherein said drive apparatus further includes:

a drive shaft connecting the sun gear to said movable apparatus, said movable apparatus including a chip breaker.

13. The drilling apparatus of claim 1, wherein said drill string includes a drill pipe having a connection structure thereon; and said drive apparatus includes a chip breaker drive assembly, said chip breaker drive assembly having a portion thereof connected to the connection structure of said drill pipe, a portion thereof engaging a portion of said borehole, and a portion thereof connected to said drill bit, said chip breaker drive assembly including:

an upper carrier connector support connected to the connection structure of said drill pipe;

a stationary gear track having a portion thereof engaging a portion of said borehole;

at least one planet drive gear engaging a portion of the stationary gear track;

at least one planet drive shaft engaging the at least one planet drive gear and a portion of the upper carrier connector support;

a lower carrier connector support connected to the at least one connection structure of said drill bit and connected to the at least one planet drive shaft; and a sun gear having a portion thereof engaging a portion of the at least one planet drive gear and connected to said movable apparatus.

14. The drilling apparatus of claim 13, wherein said drive apparatus further includes:

a drive shaft connecting the sun gear to said movable apparatus, said movable apparatus including a chip breaker.

15. The drilling apparatus of claim 12, wherein the chip breaker includes a spiral shaped member.

16. The drilling apparatus of claim 14, wherein the chip breaker includes a spiral shaped member.

17. The drilling apparatus of claim 12, wherein the chip breaker includes a spiral shaped member formed by a plurality of flails.

18. The drilling apparatus of claim 12, wherein the chip breaker includes a plurality of flails.

19. The drilling apparatus of claim 12, wherein the chip breaker includes a plurality of flails, at least one flail of the plurality of flails having a length thereof extending beyond the drill bit.

20. The drilling apparatus of claim 1, wherein said drill string includes a drill member having a connection structure thereon; and said drive apparatus includes a chip breaker drive assembly, said chip breaker drive assembly having a portion thereof connected to the connection structure of said drill member, a portion thereof engaging a portion of said borehole, and a portion thereof connected to said drill bit, said chip breaker drive assembly including:

an upper carrier connector support connected to the connection structure of said drill member;

a stationary gear track housing having a portion thereof engaging a portion of said borehole;

at least one planet drive gear engaging a portion of the stationary gear track housing;

at least one planet drive shaft engaging the at least one planet drive gear and a portion of the upper carrier connector support;

a lower carrier connector support connected to the at least one connection structure of said drill bit and connected to the at least one planet drive shaft; and a sun gear having a portion thereof engaging a portion of the at least one planet drive gear and connected to said movable apparatus.

21. The drilling apparatus of claim 20, wherein the stationary gear track housing includes:

at least one drag block assembly connected to the stationary gear track housing and having a portion thereof engaging a portion of said borehole.

22. A drilling apparatus used in a drill string having a drill member therein for drilling a borehole in an earth formation, said drilling causing said earth formation to be broken or cut into chips and debris which are transported by a flow of drilling fluid in said borehole, said drilling apparatus comprising:

a drill bit having at least one connection structure thereon for connecting said bit in said drill string and an interior passage for said flow of said drilling fluid therethrough, said drill bit having a cavity therein contacted by said chips and debris transported by said flow of drilling fluid in said borehole;

movable apparatus contained within said cavity of said drill bit, said apparatus movable in said flow of said drilling fluid in said cavity to break said chips and debris and to prevent accretion of said chips and debris or portions of said drilling fluid in an exterior area surface of said drill bit; and drive apparatus having a portion thereof connected to a portion of said drill string and having a portion thereof connected to said movable apparatus, said drive apparatus thereby causing said movable apparatus to move within said drill bit, said drive apparatus including:

a chip breaker drive assembly, said chip breaker drive assembly having a portion thereof connected to a connection structure of said drill member, a portion thereof engaging a portion of said borehole, and a portion thereof connected to said drill bit, said chip breaker drive assembly including:

an upper carrier connector support connected to the connection structure of said drill member;

a stationary gear track having a portion thereof engaging a portion of said borehole;

at least one planet drive gear engaging a portion of the stationary gear track;

at least one planet drive shaft engaging the at least one planet drive gear and a portion of the upper carrier connector support;

a lower carrier connector support connected to the at least one connection structure of said drill bit and connected to the at least one planet drive shaft; and a sun gear having a portion thereof engaging a portion of the at least one planet drive gear and connected to said movable apparatus.

23. The drilling apparatus of claim 22, wherein said drill member in said drill string is selected from the group consisting of a drill pipe, drill collar or stabilizer.

24. A drilling apparatus used in a drill string having a drill motor therein having, in turn, a drive shaft and housing for drilling a borehole in an earth formation, said drilling causing said earth formation to be broken or cut into chips and debris which are transported by a flow of drilling fluid in said borehole, said drilling apparatus comprising:

a drill bit having at least one connection structure thereon for connecting said bit in said drill string and an interior passage for said flow of said drilling fluid therethrough, said drill bit having a cavity therein contacted by said chips and debris transported by said flow of drilling fluid in said borehole;

movable apparatus contained within said cavity of said drill bit, said apparatus movable in said flow of said drilling fluid in said cavity to break said chips and debris and to prevent accretion of said chips and debris or portions of said drilling fluid in an exterior area surface of said drill bit; and drive apparatus having a portion thereof connected to a portion of said drill string and having a portion thereof connected to said movable apparatus, said drive apparatus thereby causing said movable apparatus to move within said drill bit, said drive apparatus including:

a chip breaker drive assembly, said chip breaker drive assembly having a portion thereof connected to the drive shaft of said drill motor, a portion thereof connected to the housing of said drill motor, and a portion thereof connected to said drill bit, said chip breaker drive assembly including:

an upper carrier connector support connected to the drive shaft of said drill motor;

a stationary gear track connected to the housing of said drill motor;

at least one planet drive gear engaging a portion of the stationary gear track;

at least one planet drive shaft engaging the at least one planet drive gear and a portion of the upper carrier connector support;

a lower carrier connector support connected to the at least one connection structure of said drill bit and connected to the at least one planet drive shaft; and a sun gear having a portion thereof engaging a portion of the at least one planet drive gear and connected to said movable apparatus.

* * * * *

UNITED STATES PATENT AND TRADEMARK OFFICE

CERTIFICATE OF CORRECTION

PATENT NO : 5,901,797

DATED : May 11, 1999

INVENTOR(S) : Hansen et al.

It is certified that error appears in the above-identified patent and that said Letters Patent is hereby corrected as shown below:

| | | |
|---|---|---|
| Column 1, | line 12, | insert a space after "1." and before "Field"; |
| Column 2, | line 17, | after "cutter" insert a comma; |
| Column 2, | line 29, | change "bailing" to --balling--; |
| Column 2, | line 41, | after "cutter" insert a comma; |
| Column 4, | line 7, | change "passages" to --passageways--; |
| Column 5, | line 43, | change "bottom" to --lower--; |
| Column 6, | line 1, | change "connecting" to --connection--; |
| Column 6, | line 25, | after "elongated" insert a comma; |
| Column 6, | line 60, | change "bit body 10" to --bit body 12--; |
| Column 6, | line 64, | after "connection" insert a comma; |
| Column 7, | line 15, | change "drive planet gears 60" to --planet drive gears 60--; |
| Column 7, | line 47, | change "drill" to --drive--; |
| Column 7, | line 63, | after "springs" insert --506--; |
| Column 8, | line 60, | change "bit body 10" to --bit body 12--; |
| Column 9, | line 10, | change "bore hole" to --borehole--; |
| Column 9, | line 39, | change "connection" to --connector--; |
| Column 9, | line 47, | delete the comma after "sufficient"; |
| Column 10, | line 12, | change "drillng" to --drill--; |

UNITED STATES PATENT AND TRADEMARK OFFICE

CERTIFICATE OF CORRECTION

PATENT NO : 5,901,797
DATED : May 11, 1999
INVENTOR(S) : Hansen et al.

It is certified that error appears in the above-identified patent and that said Letters Patent is hereby corrected as shown below:

| | | | |
|---|---|---|---|
| | Column 10, | line 57, | change "drilling bit" to --drill bit--; and |
| | Column 10, | line 57, | change "drill fluid" to --drilling fluid--. |
| | Column 10, | line 59, | after "204" insert a comma; |
| | Column 11, | line 2, | change "portion" to --support--; |
| | Column 11, | line 3, | after "stationary" insert --ring--; |
| Claim 11, | Column 12, | line 44, | after "the" insert --at least one--; |
| Claim 13, | Column 13, | line 2, | delete "a" (second occurrence) and insert --at least one--; |
| Claim 13, | Column 13, | line 6, | after "the" insert --at least one--; |
| Claim 13, | Column 13, | line 11, | insert --at least one-- before "connection"; |
| Claim 14, | Column 13, | line 27, | delete "a" and insert --at least one planet--; |
| Claim 20, | Column 13, | line 44, | "delete "a" (second occurrence) and insert --at least one--; |

UNITED STATES PATENT AND TRADEMARK OFFICE

CERTIFICATE OF CORRECTION

PATENT NO : 5,901,797

DATED : May 11, 1999

INVENTOR(S) : Hansen et al.

It is certified that error appears in the above-identified patent and that said Letters Patent is hereby corrected as shown below:

Claim 20, Column 13, line 48, after "the" insert --at least one--;

Claim 20, Column 13, line 54, insert --at least one-- before "connection";

Claim 22, Column 14, line 30, delete "a" (second occurrence) and insert --at least one--;

Claim 22, Column 14, line 35, after "the" insert --at least one--;

Claim 24, Column 14, line 55, delete "a" and insert --at least one planet--;

Claim 24, Column 15, line 12, insert --at least one planet-- before "drive";

Claim 24, Column 15, line 17, insert --at least one planet-- before "drive";

Signed and Sealed this

Twenty-sixth Day of December, 2000

*Attest:*

Q. TODD DICKINSON

*Attesting Officer*

*Director of Patents and Trademarks*